United States Patent [19]

VanDerLinden

[11] 4,351,552

[45] Sep. 28, 1982

[54] EMERGENCY EXIT DOOR LATCHING AND LOCKING APPARATUS

[75] Inventor: Roy E. VanDerLinden, New Windsor, Md.

[73] Assignee: Reliable Security Systems, Inc., Cockeysville, Md.

[21] Appl. No.: 22,110

[22] Filed: Mar. 20, 1979

[51] Int. Cl.[3] ..... E05C 15/02

[52] U.S. Cl. ..... 292/201; 292/DIG. 65

[58] Field of Search ..... 292/201, 144, 92, 336.3, 292/DIG. 49, 78, 21, 79, 192, 93, 209, DIG. 65; 340/542; 70/267, 268, 27 C

[56] References Cited

U.S. PATENT DOCUMENTS

| | | | |
|---|---|---|---|
| 184,297 | 11/1876 | Potter | 70/267 |
| 215,777 | 5/1879 | Shaw | 70/267 |
| 1,989,419 | 1/1935 | Hill | 70/26 |
| 2,588,010 | 3/1952 | Kennon | 16/55 |
| 2,851,296 | 9/1958 | Guyaz | 292/78 |
| 2,881,020 | 4/1959 | Kok | 292/78 |
| 3,309,125 | 3/1967 | Neveling | 292/78 |
| 3,383,130 | 5/1968 | De Avila | 292/92 |
| 3,435,643 | 4/1969 | Pollak et al. | 70/92 |
| 3,576,119 | 4/1971 | Harris | 292/144 |
| 3,583,740 | 6/1971 | Armstrong | 292/198 |
| 3,677,043 | 7/1972 | Cox | 70/92 |
| 3,767,238 | 10/1973 | Zawadzki | 292/222 X |
| 3,970,339 | 7/1976 | Haselton et al. | 292/227 |
| 4,006,471 | 2/1977 | Pappas | 340/274 R |
| 4,210,349 | 7/1980 | Cook et al. | 292/78 |

FOREIGN PATENT DOCUMENTS

| | | |
|---|---|---|
| 1130325 | 5/1962 | Fed. Rep. of Germany . |
| 7403756 | 2/1974 | Fed. Rep. of Germany . |
| 304335 | 1/1955 | Switzerland . |

*Primary Examiner*—Richard E. Moore

*Attorney, Agent, or Firm*—Quaintance & Murphy

[57] ABSTRACT

Emergency exit door latching and locking apparatus includes a closure operated latch bolt which is mounted in a U-shaped pivoted carrier link by a pair of links for projection from the carrier link to latch the door. The carrier link is connected to a toggle linkage which in a first position dogs the carrier link and bolt projected and when urged over-center allows the carrier link to pivot so as to carry the bolt to a retracted position while the bolt is still projected from the carrier link. A panic push bar is used to move the toggle over-center and to thereafter engage a projection on the door so as to urge the bolt to the retracted position due to pressure applied on the door. A detent is disposed to move between the bolt and pivot for the carrier link so as to keep the bolt projected when the detent engages a strike on the door jamb. When the door is moved from the open position to the closed position, the detent is disengaged from the pivot and the bolt retracts into the carrier link. The panic push bar is mounted by a pair of bell cranks connected with a tension rod so that tension applied anywhere on the push bar will operate the push bar to move the toggle linkage over-center. A hydraulic throttling means is connected to the toggle linkage to delay retraction of the bolt and an alarm is activated upon retraction of the bolt during the delay to signal that someone is trying to open the door.

32 Claims, 16 Drawing Figures

EMERGENCY EXIT DOOR LATCHING AND LOCKING APPARATUS

BACKGROUND OF THE INVENTION

1. Background of the Prior Art

This invention relates to locking and latching apparatus for emergency exit doors. More particularly, this invention relates to latching and locking apparatus for emergency exit doors wherein the apparatus includes structure for delaying transition of a latch or lock from a latched mode to an unlatched mode.

As explained in copending U.S. patent application Ser. No. 929,968 filed by Emanuel L. Logan on Aug. 1, 1978 and incorporated herein by reference, there is a need for a new type of emergency exit door latching and locking apparatus in which retraction of a latch bolt is delayed by loading the bolt with a hydraulic throttling system in which a liquid is throttled as the bolt is urged against the strike. The present invention is a modification of the arrangement disclosed in U.S. patent application Ser. No. 929,968 and falls within the scope thereof.

As indicated in U.S. patent application Ser. No. 929,968, there is an inherent conflict between safety and security even though these two concerns are interrelated. This conflict becoms readily apparent when one considers the problems encountered in trying to optimize the design of emergency exit doors. At least some doors of public buildings, such as schools, theaters, auditoriums, resturants, and the like must, by law, be equipped with latches or locks that can be readily opened from within the building should there be a fire or other emergency situation. These locks and latches pose a security problem since doors which can be readily opened from the inside of buildings allow people within the buildings to easily escape with stolen articles and allow people within the buildings to open the doors and admit anyone they wish to the buildings. In the minds of security people, in many instances security problems caused by easily openable emergency doors far outweigh the dangers of fire. Consequently, emergency door exits are frequently locked with chains and other devices. This is problably done because security problems arise with greater frequency than fires and must be dealt with on a day-to-day basis whereas fires occur infrequently and the dangers of fire are therefore ignored. If emergency exits are locked the results are often catastrophic when fires do occur and this causes fire departments great concern.

The approach taken by U.S. patent application Ser. No. 929,968 solves the aforediscussed problems and the present invention further discloses the concepts of that application so as to render those concepts even more commercially viable.

OBJECTS OF THE INVENTION

In view of the foregoing considerations, and other considerations, it is an object of the instant invention to provide a new and improved emergency exit door lock and latch apparatus.

It is a further object of this invention to provide a new and improved emergency exit latch and lock which includes bolt retraction structure that divorces the action of retracting a bolt for unlatching the door from retraction of the bolt to relatch the door once the door is opened.

It is a further object of the instant invention to provide a new and improved emergency exit door lock and latch wherein the latch is dogged so as to prevent unauthorized unlocking of the emergency exit door.

It is a further object of the instant invention to provide a new and improved emergency exit door lock and latch wherein a push bar is provided which will allow the latch to become unlatched regardless of where the push bar is pressed.

It is a further object of the instant invention to provide a new and improved hydraulic throttling circuit for loading an emergency exit door latch so as to delay transition of the latch from a latched to an unlatched mode.

It is a further object of the instant invention to provide a new and improved hydraulic throttling circuit for an emergency exit door latch wherein a single solenoid is used to either incorporate or bypass a throttle within the circuit depending on whether or not the latch is set for normal operation or for emergency operation.

SUMMARY OF THE INVENTION

With these and other objects in mind, the present invention contemplates a latching mechanism for a door comprising a bolt which is mounted on a support for movement between a projected position in engagement with a strike and a retracted position out of engagement with the strike. A toggle is pivoted at one end to the support and at the other end to the bolt. The toggle includes a spring which biases the toggle to a first position in which the bolt is dogged. An operator is mounted on the door for pushing the toggle from the first position in which the bolt is dogged to a second position in which the bolt is released, whereby when pressure is applied to the door after the bolt is released, the bolt will be moved to the retracted position by the strike.

The instant invention further contemplates a carrier for the bolt wherein the carrier is pivoted on the support and to the toggle so as to form a first four bar linkage, with the bolt mounted on the carrier by a pair of spaced links so as to form a second four bar linkage with the carrier being the ground or reference link. The instant invention further contemplates positioning a dogging detent between the bolt and the carrier for preventing the bolt from being retracted when the carrier is dogged by the toggle to thereby prevent unauthorized opening of the door by simply urging the bolt to its retracted position when the door is locked, without first moving the toggle over-center.

In order to utilize the above described structure with an emergency exit door latch, the instant invention further contemplates loading the latch with a fluid throttle wherein retraction of the bolt is delayed due to throttling of a fluid. The structure for throttling the fluid may include a restricted helical fluid passage mounted in a body member which is received in a bore having a geometery not complimenting the body member. Under selected conditions, the fluid bypasses the helical passage allowing rapid retraction of the bolt. In order to move the fluid through the helical path forming the throttle, a hydraulic cylinder is provided, which cylinder has a first piston moved by the latch and a second piston coaxial with and spaced from the first piston and moved by the fluid to compress air between the first and second pistons and to thereby facilitate movement of fluid from one side of the hydraulic cylinder to the other.

The instant invention additionally contemplates a push bar for releasing a latching mechanism, such as the afore described latching mechanism, wherein the push bar is mounted so that pressure on any portion of the push bar will activate the latch regardless of where the pressure is applied.

While the afore described inventive concepts are particularly useful in combination with one another to latch and unlatch or to lock and unlock, emergency exit doors, the inventive concepts are also useful in and of themselves for other purposes and apparatus.

DETAILED DESCRIPTION OF THE PREFERRED EMBODIMENT

GENERAL STRUCTURE

Figure 1:
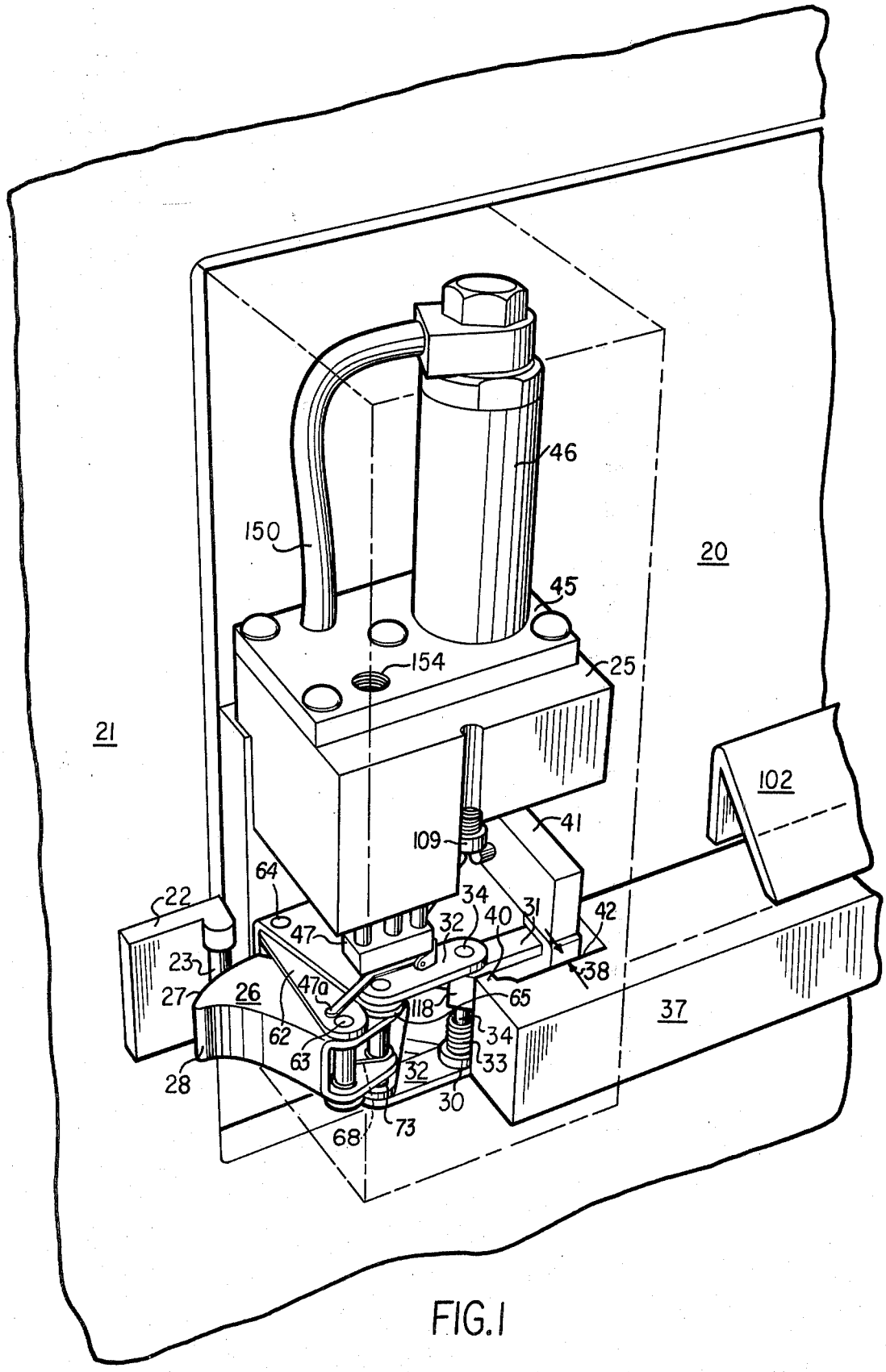
FIG. 1 is a perspective view showing a latch and lock apparatus for emergency doors in accordance with the principles of the present invention.
Figure 2:
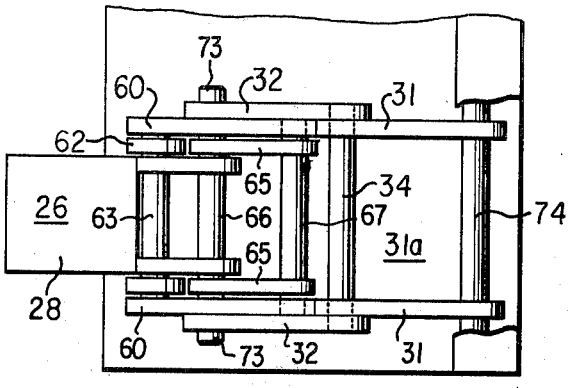
FIG. 2 is a side view of a latch bolt and associated four bar linkages used to operate the latch bolt in accordance with the principles of the present invention.

Referring now to FIG. 1, there is shown an emergency exit door 20 mounted on hinges to pivot with respect to a door jam 21 on which is mounted a keeper 22 having a strike 23. The door 20 has a latching and locking apparatus 25 mounted thereon that controls a latch bolt 26 which when projected behind the strike 23 holds the door latched or locked. The bolt 26 is closure operated in that the bolt 26 has a first cam surface 27 thereon which urges the bolt to a retracted position and unlatched mode upon pressing the door 20 so as to force the first cam surface 27 against the strike 23. When the door 20 is open the bolt 26 is projected and when the door is thereafter closed, a second cam surface 28 on the bolt 26 engages the strike 23 to urge the bolt to the retracted position so that the bolt can project behind the strike once it clears the strike.

The bolt 26 is normally "dogged" in the projected position shown in FIG. 1 by a toggle linkage 30. The toggle linkage 30 consists of links 31 and 32 pivotally connected to one another on pivot pin 34 and urged by a coil spring 33, mounted coaxially on pivot pin 34, to a first position in which the bolt 26 is dogged. Upon "breaking" the toggle 30 by moving the toggle overcenter toward a second position, the bolt 26 becomes undogged so that pressure on the door 20 applies the camming force to the cam surface 27 via strike 23 to thereby retract the bolt 26. In the preferred embodiment, the toggle 30 is broken by a push bar 37 that can move toward the door 20 by a distance 38 which is sufficient to break the toggle 30 by engaging the toggle with a projection 40 without further pushing the toggle toward the second position in which the bolt 26 is retracted. The distance 38 is determined by a projection 41 fixed to the door which is engaged by a surface 42 on the push bar 37 after the push bar 37 has been depressed to undog the bolt 26. Any force applied to the push bar 37 after the toggle is broken is transmitted by the projection 41 directly to the door 20 so as to cam the bolt 26 to the retracted position.

Figure 15:
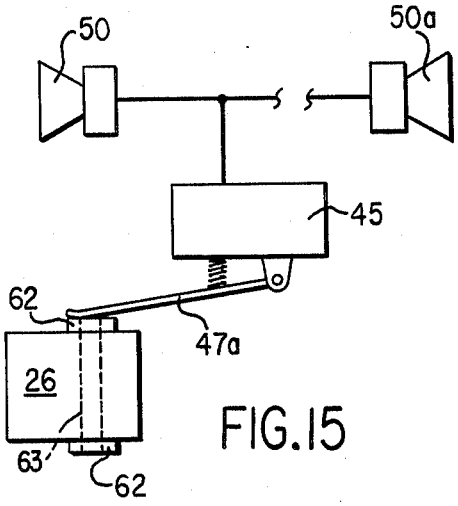
FIG. 15 is a schematic diagram of an alarm circuit which operates by a switch that is closed upon starting to retract a bolt upon trying to open the door upon which the bolt is mounted.

As will be further explained here-in-after, pressure applied to the bolt 26 is transferred through to a hydraulic throttling circuit 45 which delays retraction of the bolt by coupling the retraction to a throttle which limits the speed at which fluid can move from one side of a hydraulic cylinder 46 to the other side of the cylinder. During the time that the fluid is being throttled, a microswitch 47 is closed so as to energize an alarm system, generally designated by numeral 50 (See FIG. 15). The alarm 50 may include audio and visual signals. Preferrably, an alarm is located near or on the door 20 so as to sound when one tries to open the door to let the person opening the door know that his attempt to exit has been detected. In addition, an alarm may be located at a distant, central security station to alert personnel that the door is being tampered with.

As will be further explained hereinafter, the throttling mechanism in the hydraulic circuit 45 can be bypassed if an emergency situation occurs or if there is a power failure in the building. This is accomplished by connecting a normally open solenoid operated valve to devices such as smoke alarms and fire boxes which when activated trip a drop-out relay that interrupts current to the normally open valve allowing the bypass to occur.

LATCHING AND LOCKING STRUCTURE

As is seen in FIGS. 2 through 6, the bolt 26 is carried by a carrier link 60 which is U-shaped in cross section and is pivoted to a support structure 61. The bolt 26 is pivoted to a first pair of links 62 by pivot pin 63 and the first pair of links 62 are pivoted to the carrier link 60 by pivot pin 64. The bolt 26 is also pivoted to a second pair of links 65 by pivot pin 66. In FIGS. 1, 2, 3, 4, 5 and 5*a* pin 66 is under pivot 73. The link pairs 62 and 65 cooperate with the bolt 26 to form the moveable links of two parallel four bar linkages of which the carrier link 60 as a frame of reference or ground.

Figure 6:
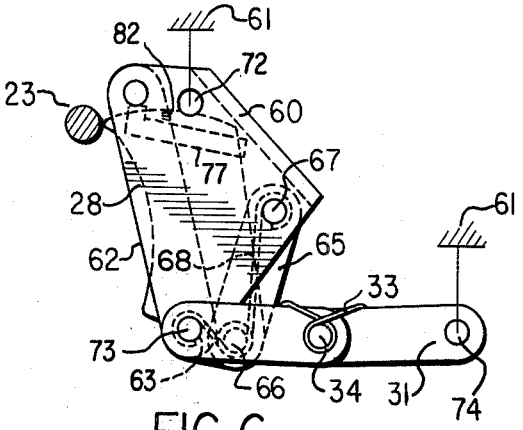
FIG. 6 is a view showing the latch bolt retracted into the carrier link with the toggle linkage again in the first dogging position to prevent the carrier link from retracting so that the latch will be in position to be locked or dogged once the door on which it is mounted is shut.
Figure 5A:
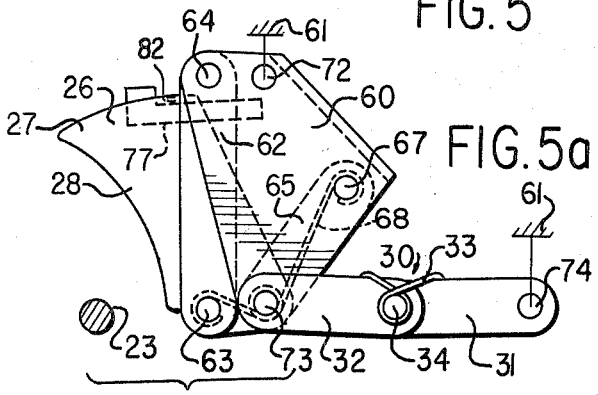

As seen in FIG. 6 the bolt 26 can move back into the carrier link 60 but is normally held projected therefrom by a coil spring 68 which is coaxial with pivot pin 66 has one tail around the pivot pin 63 and the other around pivot pin 67.

The carrier link 60 is pivoted to the support structure 61 by a pivot pin 72 which is spaced from the pivot pins 63, 64, 66 and 67 supporting the bolt 26 within the carrier link 60. The toggle linkage 30 which includes the parallel links 32 and 31 which are pivoted to one another by pivot pin 34, is pivoted to the carrier link 60 by pivots 73 and to support structure by pivot 74. Pivots 73 are outside pivot pin 66. The parallel links 31 are held separate and in rigid relation to one another by a web 31*a*. Parallel links 31 fit inside the parallel links 32 so that the web 31*a* holds the links 32 spaced apart as well as holding the links 31 spaced apart. The carrier link 60 therefore forms one link of a four bar linkage including the toggle 30 with the support 61 forming, in effect, a rigid link in the four bar linkage.

Figure 3:
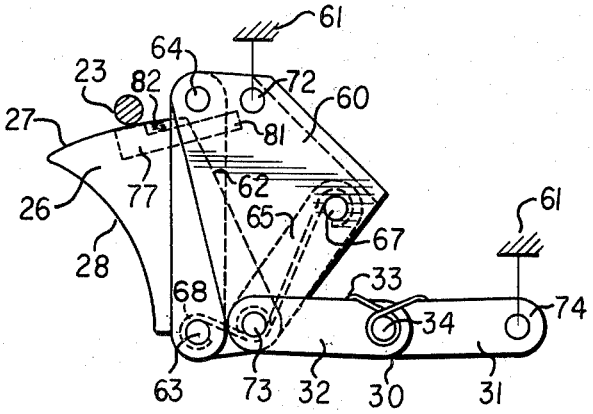
FIG. 3 is a top view of the latch bolt in accordance with the instant invention showing a toggle link overcenter in a first position to dog a carrier for the latch bolt so as to hold the latch bolt projected.
Figure 4:
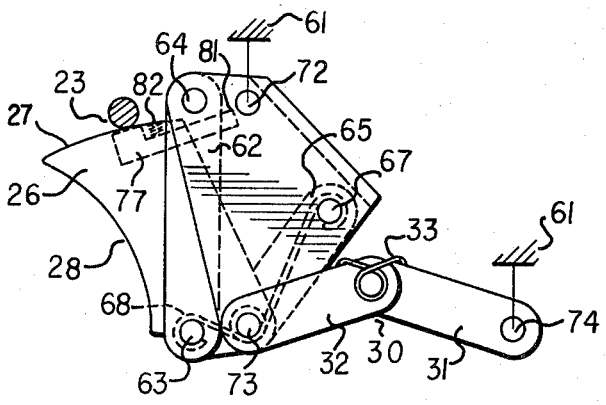
FIG. 4 is a view similar to FIG. 3 but showing the toggle linkage broken by being pushed slightly overcenter so that a striker may cam the latch bolt back with a carrier link which mounts the bolt.
Figure 5:
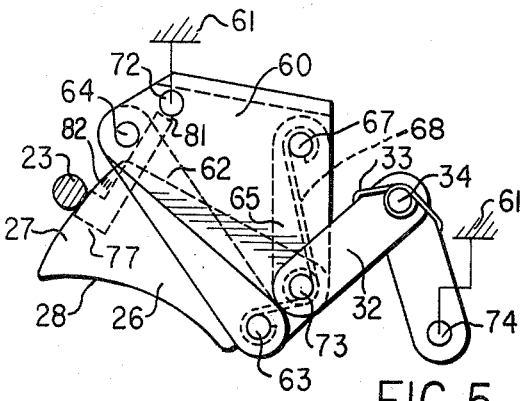
FIG. 5 is a view similar to FIG. 4 showing the latch bolt retracted by collapsing the toggle linkage to a second position so that the bolt will clear the strike.

The toggle linkage 30 is normally biased to a first position as shown in FIG. 3 by the spring 33 so as to maintain carrier link 60 positioned so that the bolt 26 remains projected. When in the first position, the toggle linkage 30 is in effect over-center and blocked from collapse by a cam configured as a bell crank which operates the cylinder 46 and is connected to the pivot pin 34, as will be further explained hereinafter. It is only important to remember at this point that force applied to the carrier link 60 through bolt 26 tends to jam the toggle linkage 30 in the first position so as to block rotation of the carrier link. When the linkage 30 is moved over-center to the position shown in FIG. 4 pressure on the bolt 26 tends to collapse the toggle link 30 to a second position shown in FIG. 5 wherein the latch bolt 26 has been retracted by being pulled back by the carrier link 60. The coil spring 33 continually urges the toggle linkage 30 toward the first position so that the bolt 26 is projected from the carrier even when the linkage 30 is over-center from the first position and in second position. Accordingly, the bolt 26 is urged projected by the bias of spring 33 which urges the carrier link 60 to project the bolt 26 and by spring 68 which urges the bolt 26 to project from the carrier link itself.

A detent 77 projects from an opening 78 in the bolt 26 so as to be engageable with the striker 23. The detent 77 has a surface 81 which abuts the pivot pin 72 in the carrier link 60 to prevent the bolt 26 from retracting into the carrier link 60 when a force is applied thereto. However, the surface 81 which abuts the pivot pin 72 is normally urged out of alignment therewith by a spring 82 which biases the detent 77 in a clockwise direction so as to clear the pivot pin 72. When the detent 77 engages the strike 23 and is pushed back into the bolt 26 the detent 77 pivots against the bias of spring 82 so as to abut the pivot pin 72 and dog the bolt projected relative to the carrier link 60. When there is no engagement with the strike 23 the bolt 26 is not dogged with respect to the carrier link 60 and can retract back into the carrier link.

In operation, the aforedescribed bolt and linkages serve to provide a mechanism which both latches the door 20 and locks the door but allows the door to be quickly opened in an emergency situation. When the door 20 is shut, the bolt 26 is projected by both the spring 68 which urges the bolt from the carrier 60 and by the spring 33 which urges the carrier to move the bolt so as to project from the door. The bolt is dogged in its projected position by the toggle linkage 30 which assumes the first position shown in FIG. 3 due to the biasing action of the spring 33.

In order to open the door, the push bar 37 is pressed inwardly so that the projection 40 pushes the toggle away from its first position and over-center so that force on the bolt applied through the carrier 60 will collapse the toggle 30 and move the toggle 30 toward its second position carrying the bolt 26 back with it. The detent 77 engages the strike 23 as pressure is applied to the door 20 and is moved against the bias of the spring 82 to abut with the pivot pin 72 which dogs the bolt 26 with respect to the carrier link 60 so that pressure applied against the first surface 27 of the bolt is transmitted to the carrier link and causes the carrier link to pivot about pivot pin 72 allowing the bolt 26 to retract. After the bolt 26 clears the strike, the door 20 will open and the bolt 26 will thereafter project from the carrier link 60 while the carrier link is reprojected as the toggle linkage 30 is urged to its first position by the coil spring 33. Upon closing the door, the second cam surface 28 will engage the strike 23 and cause the bolt 26 to be cammed back into the carrier link 60 which is now held projected by the toggle linkage 30 that is in the first position. The bolt 26 is not dogged by detent 77 because the spring 82 is biasing the detent so that the surface 81 clears the pivot pin 72. Not until the juncture of the first and second cam surfaces 27 and 28 has cleared the strike 23 will the bolt begin to project so as to latch and lock the door. The bolt 26 moves to its projected position with respect to the carrier link 60 due to the action of the spring 68 which shifts the first and second links 62 and 65 to project the bolt. The bolt 26 is projected until the detent 77 slightly clears the striker 23. The bolt 26 now both latches and locks the door and the door can not be opened without pressing on the push bar 37 so as to break the toggle 30. The detent 77 prevents one from pushing the bolt 26 to its retracted position by using a device to cam the bolt back. As soon as the detent 77 hits the strike 23, the bolt can not be cammed into the carrier link 60 because the detent hits the pivot pin 72. This locks the bolt and provides security against unauthorized entry of the building. The aforedescribed mechanism is especially suitable for an emergency door lock or latch, and particularly suitable when the emergency exit door lock or latch has a delay means and alarm means associated therewith.

THE PUSH BAR

Figure 7:
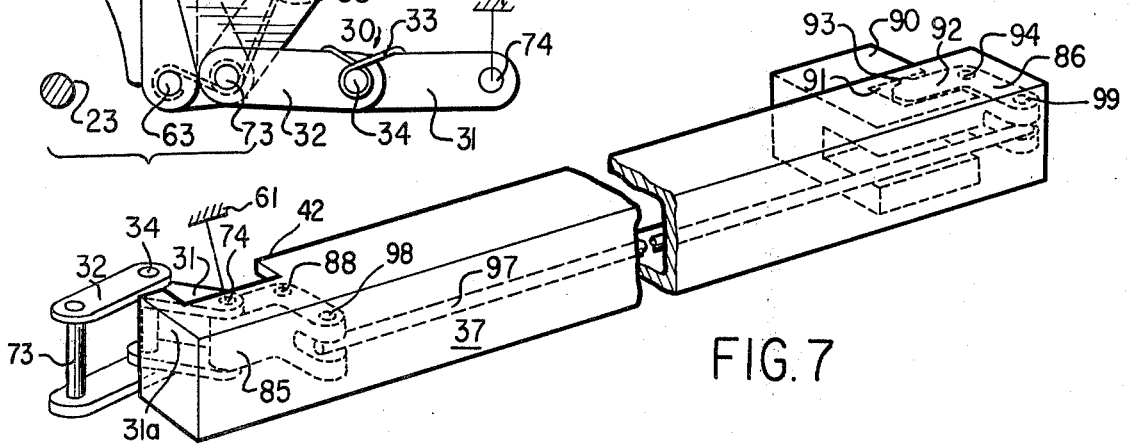
FIG. 7 is perspective view of a push bar used to move the toggle linkage to the position shown in FIG. 4 from the position shown in FIG. 3.
Figure 8:
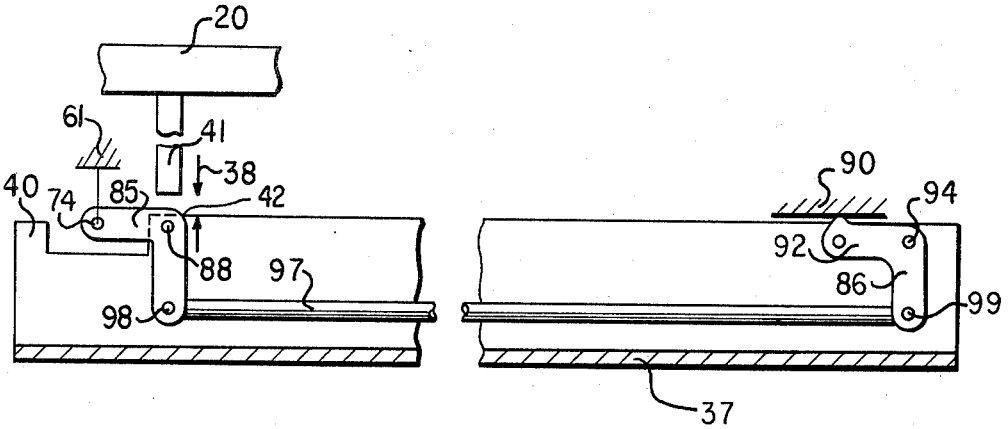
FIG. 8 is a top view of the push bar of FIG. 7 showing a mounting arrangement for the push bar which includes a pair of bell cranks pivoted adjacent opposite ends of the push bar and connected together by a tension rod.

Referring now to FIGS. 1, 7, and 8, the push bar 37 is mounted by a pair of bell cranks 85 and 86 to move the projection 40 toward the door 20 so as to push the toggle linkage 30 over-center. Bell crank 85 is pivoted to the support structures 61 by the pin 74 which attaches the pair of links 31 and 32 of the toggle linkage 30 to the support structure. A pin 88 pivotally secures the push bar 37 to the bell crank 85. The bell crank 86 is pivoted to the support structure 61 by a stanchion 90 having a slot 91 therein which receives one arm 92 of the bell crank 86. The arm 92 has a rib 93 thereon which serves as a pivot for the bell crank so that the bell crank pivots with respect to the stanchion 90 and the support structure 61. A pivot pin 94 pivots the push bar 37 to the bell crank 86 so that the push bar 37 is retained at both ends to door 20.

Extending between the bell cranks 85 and 86 is a tension rod 97 which is pivoted to bell crank 85 by pivot pin 98 and to bell crank 86 by pivot pin 99. Upon pressing the push bar 37 at either end the entire push bar moves toward the door so that the projection 40 will break, or rather move, the toggle linkage 30 over-center. If the push bar 37 is pushed at the end adjacent the hinge edge of the door, bell crank 86 will pivot about rib 93 moving the tension rod 97 to the right which rotates the bell crank 85 about pivot pin 74 which is attached to the support structure. This causes the bell crank 85 to rotate in a counter clockwise about pivot 74 moving the pivot pin 88 counter clock-wise or toward the door which necessarily carries the push bar 37 toward the door and engages the projection 40 with the toggle linkage 30. If the push bar 37 is engaged at the end near the lock then the push bar moves toward the door because the bell crank 85 to which it is attached pivots about pivot 74 and the pivot pin 88 connecting the bell crank to the push rod permits the push rod to rotate very slightly with respect to the bell crank and therefore move toward the door 20.

It is only necessary that the push bar 37 push the toggle linkage 30 over-center so that the linkage no longer dogs the bolt 26 by jamming the carrier link 60. Consequently, after the push bar 37 has been depressed enough to close the gap 38, the push bar abuts the projection 41 on the door so that all force applied to the push bar is now applied to the door and transmitted to the interface between the first cam surface 27 on the latch bolt 26 and striker 23. As described herein before, pressure on the door 20 causes the latch bolt 26 to retract slightly so that the detent 77 engages strike 23 thereby dogging the bolt 26 with respect to the carrier link 60. Further pressure on the door cams the bolt and carrier link 60 so as to move the toggle linkage 30 to a second position. It is again emphasized that the push bar 37 is merely used to undog the latch 25 so that the bolt 26 may be cammed to the retracted position by the strike 23 and thereby provide a closure operated latch. As stated herein before, the latch 25 is designed with low frictional losses so that it can not jam when pressure is applied against the door and transmitted through the latch structure. After the toggle linkage 30 is broken by the bar 37, any pressure against the door 20 will result in retraction of latch bolt 26 and opening of the door.

The bar 37 fits in a slot 101 defined by pairs of flanges 102 and 103. The flange 102 slopes downwardly into sliding engagement with the topside of the push bar 37 while the lower flange 103 slopes upwardly into sliding engagement in the bottom side of push bar 37. The flanges prevent objects from being intentionally or unintentionally inserted between the push bar 37 and the supporting structure for the push bar and help to define a channel through which electrical wires can be carried from the latch to the hinged edge of the door. A cover 104 fits over the latch 25 to protect the latch mechanism. As can be readily seen, the push bar 37 cooperates with the latch 25 to provide a secure and safe emergency exit door latch and lock.

Figure 9:
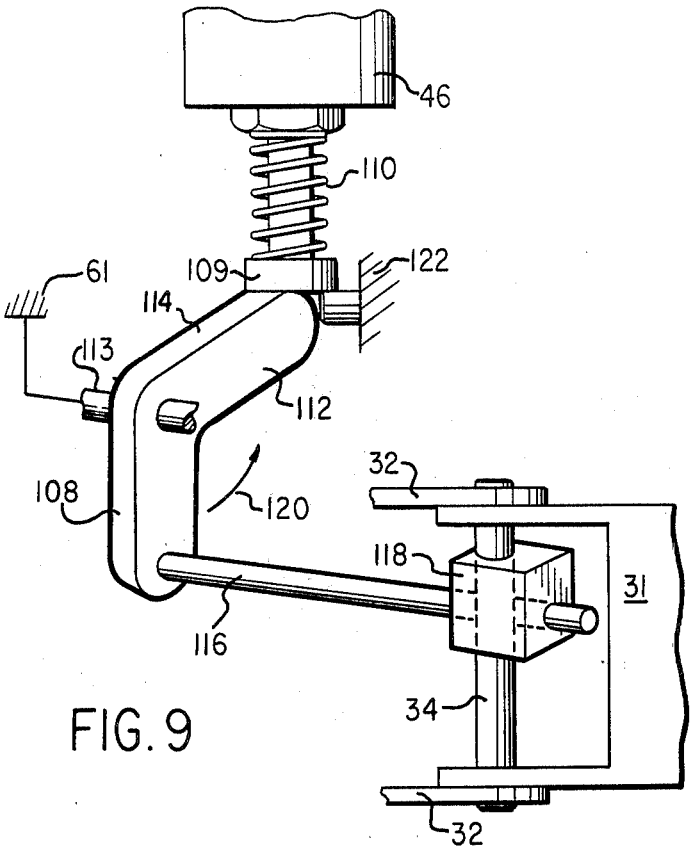
FIG. 9 is a side view showing a linkage utilizing a sliding block, a rigid rod, and bell crank with a cam surface thereon to move a piston within a hydraulic cylinder used to load the latch bolt so as to delay retraction of latch bolt.

In order to enhance the security features of the emergency exit door latch and lock resulting from the combination of the push bar 37 and latch 25, the hydraulic throttle circuit 45 is connected to the bolt 26 through the cam and linkage mechanism 108 of FIG. 9 so as to move a piston rod follower 109 against the bias of a spring 110 to displace fluid within the hydraulic cylinder 46 which fluid is throttled as it is displaced as will be described here-in-after. The rate at which the toggle linkage 30 collapses is controlled by the rate at which the fluid is throttled. The rate at which the fluid is throttled is substantially independent of force applied on the door 20 as long as force applied is above a threshold force which may be, for example, about 15 pounds.

The cam and link mechanism 108 consists of a bell crank 112 which is pivoted to the support structure 61 by a pivot 113. One arm of the bell crank 112 forms a cam 114 which abuts the piston rod 109, while the other arm of the bell crank has a connecting rod 116, rigidly connected thereto, that registers with a bore 117 in a sliding block 118. Sliding block 118 has a bore 119 perpendicular to the bore 117 and is slideably and rotatably mounted on pivot pin 34 which connects the link pairs 31 and 32 together to form the toggle linkage 30. The pivot pin 113 which mounts bell crank 112 has an axis in a plane normal to the plane containing the axis of pivot pin 34. The rigid rod 116 is parallel to the pivot pin 113 and at a 90° angle to the pivot pin 34. As the toggle link 30 moves from its first position (FIG. 3) toward its second position, (FIG. 5) the block 117 slides down the pivot pin 34 to rotate the bell crank 112 in the direction of arrow 120 to bring the cam 114 into engagement with the piston rod follower 109 which normally rests on a stop 122. The stop 122 ensures that the hydraulic cylinder 46 does not load the latching mechanism 25, generally, and the toggle linkage 30, specifically, before the toggle linkage is pushed overcenter by the projection 40 on the push bar 37. Consequently, the only forces which must be overcome to undog the latch 25 are the relatively weak spring force of the coil spring 33, which biases the toggle linkage 30 to the first position, and the frictional loads in the toggle linkage and in the link and cam mechanism. As a result, the hydraulic cylinder 46 does not load the latch 25 until pressure between the bolt 26 and keeper 23 moves rotates the carrier link 60 so as to move the toggle linkage 30 toward its second position.

THE HYDRAULIC CIRCUIT AND THROTTLING MEANS

Figure 10:
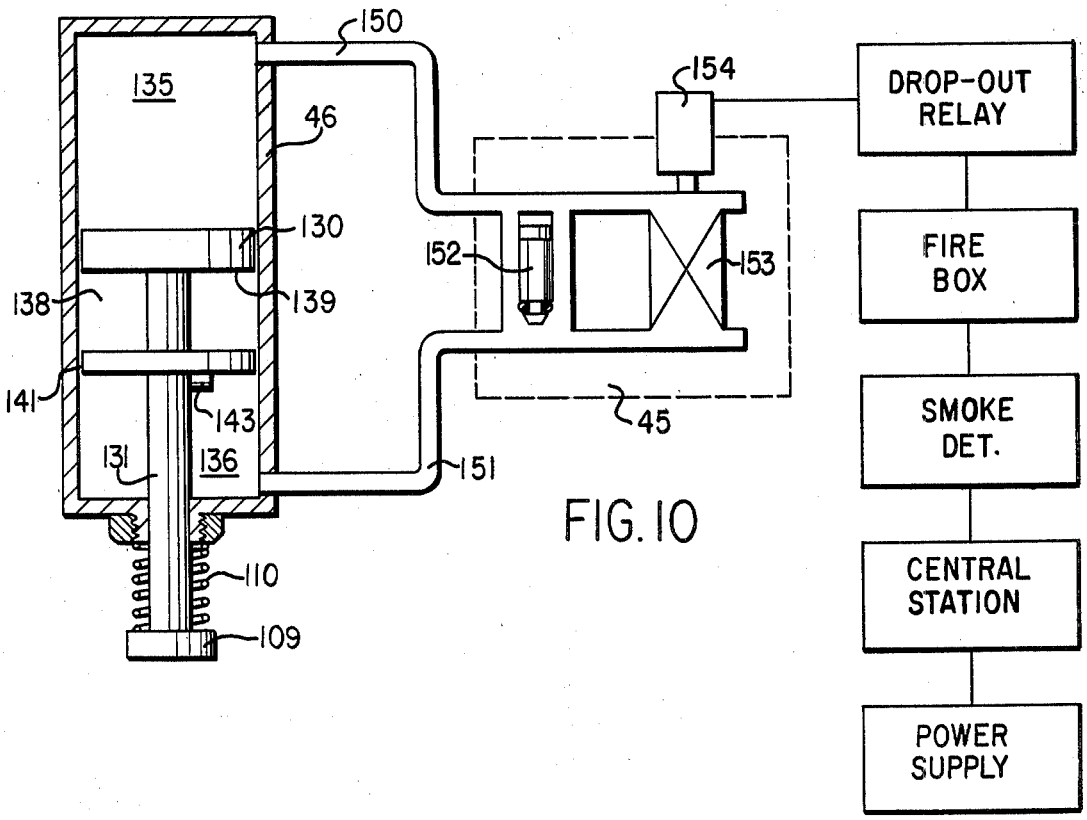
FIG. 10 is a schematic view showing a circuit for throttling a hydraulic fluid selectively as the fluid is displaced in a hydraulic cylinder and showing a block diagram for operating a solenoid that controls the circuit.
Figure 11:
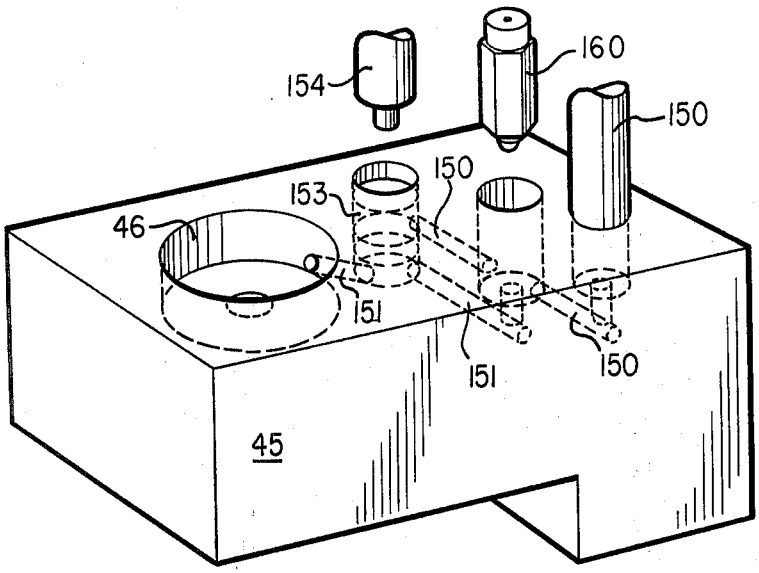
FIG. 11 is a perspective, schematic view of another type of hydraulic circuit embodying some of the principles shown in the hydraulic circuit of FIG. 10.

As is seen in FIG. 10, the hydraulic cylinder 46 includes a piston 130 therein which is connected by a piston rod 131 to the piston rod follower 109. A hydraulic fluid, such as the automatic transmission fluid used in automobiles, is contained within the hydraulic cylinder 46 and is displaced from a front chamber 135 of hydraulic cylinder through the hydraulic delay circuit 45 and accumulated in a rear chamber 136 on the other side of piston 130. The cylinder 46 is not completely filled with hydraulic fluid but includes a gas, such as air, contained in a space 138 adjacent the back surface 139 of the piston 130. As the fluid is transferred from chamber 135 to chamber 136, the air in the space 138 is compressed to provide additional volume in the chamber 136 which compensates for the space in the chamber 136 consumed as the piston rod 131 moves into the chamber.

Preferably, there is a floating piston 141 which is coaxially and slideably mounted on the piston rod 131 above a stop 143 secured to the piston rod. The floating piston 141 can move toward the fixed piston 130 to compress air in space 138. By using the floating piston 141, the air is retained in space 138 so that the cylinder 46 can be oriented with the piston rod projecting upwardly instead of downwardly, without the concern that air in the chamber 136 will float to the top (of the inverted cylinder 46) and escape through the seal between piston rod 131 and the end of the cylinder. It is preferable to have hydraulic fluid adjacent the seal between the piston rod 131 and housing of the hydraulic cylinder 46 because hydraulic fluid will not leak as readily as air.

Moreover, by using the floating piston 141, the spring 110 which urges piston rod 131 to project from the cylinder 46 can be assisted or perhaps dispensed with. If the air in space 138 is compressed due to fluid accumulated in chamber 136 pushing the floating piston 141 away from the stop 143 toward the piston 130 and if pressure urging the piston back into the hydraulic cylinder such as applied by cam 114 is relieved, then the air in space 138 will expand, pushing the floating piston 141 in a direction away from the piston 130 so as to force fluid from the chamber 136 into the chamber 135, which in turn moves the piston 130 to project the piston rod 131. When the floating piston 141 hits the stop 143, the system reaches equilibrium and the piston rod 131 is pushed no further out of the hydraulic cylinder 46 due to expansion of the air in the space 138.

The cylinder 46 may be used without the floating piston 141 and may for example be a cylinder made by the Clippard Instrument Laboratory, Inc. of Cincinnati, Ohio Model 7SD.

The hydraulic delay circuit 45 is connected to the front chamber 135 by a hydraulic line 150. Another hydraulic line 151 connects the hydraulic delay circuit 45 to the accumulating side 136 of the cylinder 46. In order to control the flow of the fluid, a check delay valve 152 is included in the circuit 45 as is a normally open solenoid operated valve 153. When the normally open valve 153 is open, hydraulic fluid can be transferred rapidly from the front chamber 135 to the rear chamber 136. When the normally open valve 153 is closed, then the hydraulic fluid must flow through the check delay valve 152 which throttles the fluid so that transfer of the fluid from the front chamber 135 to the rear chamber 136 is delayed, thereby delaying retraction of the bolt 26 by loading the toggle linkage 30 through the bell crank 112, rod 116 and sliding block 118. The normally open valve 153 is closed by energizing a solenoid 154. The solenoid 154 is connected to a drop out relay which is operated by a central control panel, smoke alarm, fire box or the like as disclosed in copending application Ser. No. 929,968 filed Aug. 1, 1978 in the name of Emanuel L. Logan and incorporated herein by reference. If an emergency condition is detected, the drop out relay will cause the solenoid 154 to deenergize and the normally open valve 153 to open, allowing the hydraulic fluid to flow quickly from line 150 to line 151 and into the back chamber 136. The normally open valve is of the type manufactured by the Clippard Instrument Laboratory, Inc. of Cincinnati, Ohio under Model No. MAVO-2C.

Figure 12:
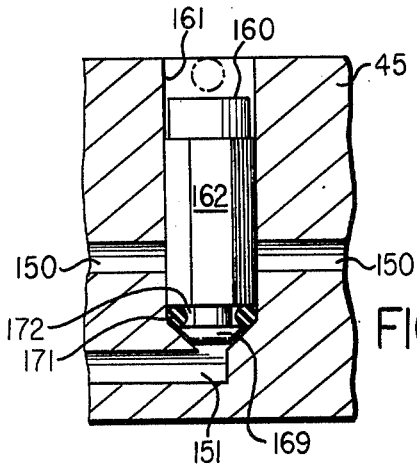
FIG. 12 is a side elevation showing a throttle arrangement wherein a body member is selectively positioned to either throttle hydraulic fluid or to pass the hydraulic fluid quickly.
Figure 13:
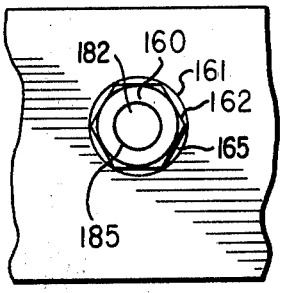
FIG. 13 is a top view of the throttle of FIG. 12.
Figure 14:
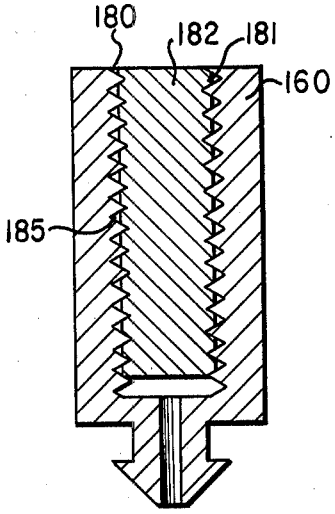
FIG. 14 is a section taken through a body member showing a helical path formed by a bore with a helical internal thread which receives a plug having a complimentary helical external thread with a diameter less than the diameter of the internal thread.

The check delay valve 152, shown in FIGS. 12, 13 and 14, includes a body member 160 which is received in a circular bore 161 through the support member 45. The body member 160 has a hexagonal portion 162. The bore 161 has a diameter which approximates the largest diameter of the hexagonal portion 162, so that when the body member 160 is placed in the bore 161, a space 165 is defined between the bore 161 and the body member 160. The bore 161 has a conical bottom portion 168 and the body member has a conical head 169 which approximates the conical bottom 168. An o-ring seal 171 is positioned in a groove 172 just before the conical head 169 so as to seat against the bottom of the bore 161 when the body member 160 is pressed downwardly. When the o-ring 171 is seated, fluid can not flow down the space 165, however when the o-ring is not seated against the bottom of the bore 161, fluid can flow in the space 165. Consequently, when the normally open valve 153 is closed and fluid is returned from chamber 136 through line 151, the fluid will pass through the space 165 to the line 150 so that it can be returned to the front chamber 155 of the hydraulic cylinder 46.

In order to throttle the fluid with the check delay valve 152, the body member 160 has a helical groove 180 formed or cut therein in which a complimentary helical thread 181 on a plug 182 is received. The outer diameter of the thread 181 is less than the major diameter of the helical groove 180 so as to define a helical or spiral path 185 between the plug and body member 160. In this way a relatively long fluid path 185 can be confined in a relatively short valve. For example, a fluid path of approximately 19 inches can be contained within a body member 160 having a length of approximately 6/10 of an inch. When a normally open valve 153 is closed, pressure in the line 150 increases to a level sufficient to move the body member 160 so as to seat the seal 171 against the bottom 168 of the bore 161 so that fluid can not flow through the space 165 between the body member 160 and the bore 161. Consequently, the fluid must flow through the helical path 185 and is thereby throttled so as to delay transfer of the fluid from the front chamber 135 of the hydraulic cylinder 46 to the rear chamber 136 of the hydraulic cylinder.

While the fluid is being throttled as it traverses the path 185, retraction of the bolt 126 is delayed and the switch 47 (See FIG. 1) connected to an alarm system (such as that in copending U.S. patent application Ser. No. 929,968 filed Aug. 1, 1978 in the name of Emanuel L. Logan and incorporated herein by reference) will sound indicating that someone is trying to open the door 20. The switch 47 has an arm 47*a* which overlies the first link 62 connecting the bolt 26 to the carrier link 60. As the bolt is cammed toward its retracted position, the arm 27 is biased so as to drop off the first link 62 thereby closing the switch 47 to activate the alarm. The switch 47 is therefore operated by the motion of the bolt 26 and the four bar linkage associated therewith (links 62 and 65) rather than by operation of the push bar 37. Accordingly, the nuisance of having an alarm go off every time someone pushes the push bar either by mistake or mischieveously is avoided. A person has to actually try to open the door 20 before the alarm sounds.

SUMMARY OF OPERATION

The aforedescribed elements and systems are combined to provide an emergency exit door latch and lock which optimizes the dual functions of safety and security by providing both a warning that the emergency exit door is being opened without authorization and time to investigate why the door is being opened before exit is gained. This is accomplished by loading the toggle linkage 30 with a hydraulic fluid which is throttled by the check delay valve 152 as the toggle linkage collapses due to force between the bolt 26 and the striker 23. As the linkage 30 collapses, the switch 47 closes to sound an alarm.

The toggle linkage 30 is normally biased to a dogging position which blocks retraction of the bolt 26 and is pushed over-center to an undogged position by projections 40 on the push bar 37. The push bar 37 is mounted by the bell cranks 85 and 86 which are joined by tension rod 97 so that pressure on the push bar will break the toggle linkage 30 regardless of where the pressure is applied. The push bar 37 bottoms on a projection 41 extending from the door 20 so that after the linkage is moved slightly over-center, pressure on the push bar will thereafter be applied through the door 20 to the interface of the bolt 26 and the keeper 23. Pressure on the bolt 26 will continue to collapse the toggle linkage 30 and allow the bolt 26 to retract while still being projected from the carrier link 60 due to the dogging detent 77 which rigidifies the four bar linkage consisting of the bolt 26, link 62 and link 65 by engaging the pin 72 on the carrier link 60.

After the door is opened, the bolt 26 is again biased to the projected position. When the door is shut, bolt 26 retracts back into link 60 because the dogging detent 77 is not pressed into the bolt so as to engage the pivot pin 72 on the carrier link 60.

For safety, the check delay valve 152 which throttles the fluid is normally bypassed by using the normally open valve 153 between the front and rear chambers of the hydraulic cylinder 46. When the normally open valve 153 is closed by the solenoid 154, a high pressure condition occurs in the line 150 which seats the body member 160 within the bore 161 causing the hydraulic fluid to traverse the helical path 185 through the body member thereby throttling the fluid.

The afore described apparatus provides emergency exit doors with a safe secure latch and lock which is compact in design and configuration and may be readily utilized with existing or new emergency exit doors.

What is claimed is:

1. A latch for an emergency exit door door said latch being operable from inside an enclosure comprising:

bolt means including a bolt for engaging a strike;

support means for supporting the bolt means on the door;

mounting means for mounting bolt means on the supporting means for movement between a projected position in which the strike is engaged and a retracted position in which the strike is bypassed by the bolt;

toggle means pivoted at one end to the support means and at the other end of the bolt means at a point on the bolt means, which toggle means is moveable between a first position in which the toggle means dogs the bolt means in the porjected position and a second position in which the toggle means allows the bolt to move to the retracted position, the toggle means including means for biasing the toggle means to the first position for holding the bolt projected;

delay means connected to the toggle to delay movement of the bolt from the projected to the retracted position after the toggle has been moved from the first position to the second position;

operating means mounted on the support means for moving the toggle means from the first position to the second position, whereby when pressure is thereafter applied to the door the bolt will be moved to the retracted position by the strike;

means on the door and responsive to pressure on the door for indicating that an attempt has been made to open the door.

2. The latch means of claim 1 wherein the means for mounting the bolt means includes pivot means about which the bolt means rotates when moving between the projected and retracted positions.

3. The latch of claim 2 wherein the bolt means comprises:

a bolt carrier pivoted to the support at one location and to the toggle means at another location, the bolt carrier including means for mounting a bolt for movement relative thereto.

4. The latch of claim 3 wherein the means for mounting the bolt on the carrier comprises a first link pivoted at one end to the carrier and at the other end to the bolt and a second link pivoted at one end to the carrier and at the other end to the bolt, whereby the bolt forms a middle moveable link of a four-bar linkage which includes the carrier and wherein the bolt is restrained by the first and second links.

5. The latch of claim 4 further comprising:

detent means projecting from the bolt for engagement with the strike upon rotation of the bolt, and means for moveably mounting the detent means for movement between a first position in which the detent means blocks rotation of the bolt relative to the carrier upon engagement between the detent means and the strike and a second position in which the detent means clears the carrier to permit rotation of the bolt relative to the carrier.

6. The latch of claims 1, 2, 3, 4, or 5 wherein the delay means includes:

means for throttling a fluid;

means for driving the fluid throttling means;

means for connecting the toggle to the throttle driving means whereby the fluid is throttled as the toggle collapses while the bolt moves from the projected to the retracted position to thereby retard movement of the bolt means from the projected to the retracted position.

7. The latch of claims 1, 2, 3, 4, or 5 wherein the delay means includes:

means for throttling a fluid;

means for driving the fluid throttling means and means for connecting the toggle to the throttle driving means to throttle the fluid as the toggle collapses while the bolt moves from the projected to the retracted position to thereby retard movement of the bolt means from the projected to the retracted position;

and wherein the indicating means includes:

means connected to the bolt for activating an alarm signal upon movement of the bolt from the projected to the retracted position wherein the alarm signal is given during the delay.

8. The latch of claims 1, 2, 3, 4, or 5 wherein the delay means includes:

means for throttling a fluid;

means for driving the fluid throttling means;

means for connecting the toggle to the throttle driving means to throttle the fluid as the toggle collapses while the bolt moves from the projected to the retracted position to thereby retard movement of the bolt means from the projected to the retracted position wherein the indicating means includes:

means for activating an alarm signal upon movement of the bolt from the projected to the retracted position whereby the alarm signal is given during the delay;

and wherein the latch further includes:

means on the support means for engaging the operating means to prevent further movement of the toggle by the operating means and to transmit force applied to the operating means through the operating means and directly to the support and the door.

9. Emergency door operating apparatus comprising:

latching means including a bolt for movement between latched and unlatched modes;

a push bar;

a first bell crank having first and second ends and pivoted intermediate the ends to the push bar;

a second bell crank having first and second ends and pivoted intermediate the ends to the push bar at a location spaced from the first bell crank;

means adjacent a first end of the first and second bell crank for pivoting the bell cranks relative to the door;

a tension rod extending between second ends of the bell cranks for transmitting force between bell cranks upon applying force at either end of the push bar, wherein the push bar moves toward the door upon application of force to the push bar;

latch operating means at one end of the push bar for operating the latching means upon movement of the push bar with respect to the door;

dogging means for holding the door latched, wherein the dogging means is deactivated upon engagement by the push bar for allowing the latch to assume an unlatched mode; wherein the dogging means is a toggle link which dogs the bolt when in one configuration and releases the bolt for movement to unlatched mode when in a second configuration;

an abutment extending from the door and spaced from the push bar for engaging the push bar after the operating means has pushed the toggle to the second configuration to thereafter transmit force applied to the push bar directly to the door whereby the force on the door is used for retracting the bolt;

fluid throttling means for loading the bolt after the toggle moves from the first configuration to the second configuration, whereby force on the door causes fluid to be throttled which delays opening of the door; and means connected to the bolt for indicating that an attempt has been made to open the door by pressing against the push bar.

10. The emergency door operating apparatus of claim 9 wherein the toggle is pivoted at one end to the mounting pivot of the first bell crank and at the other end to the bolt.

11. The emergency door operating apparatus of claim 9 wherein the latch means comprises a carrier pivotally connected in one location to the toggle and at the other location to the door and wherein a latch bolt is moveably mounted in the carrier for movement with respect thereto.

12. The emergency door operating apparatus of claim 11 wherein the means for mounting the bolt include a first link pivoted in one location to the cage and a second link pivoted at a second location to the cage with the bolt pivoted to the other ends of the links.

13. The emergency door operating apparatus of claim 12 further including detent means projecting from the bolt means for movement between a blocking position which prevents retraction of the bolt within the carrier to an unblocking position in which the bolt may move back within the carrier upon engaging a strike.

14. The emergency door operating apparatus of claim 13 wherein the bolt has a first surface for engaging the strike when the bolt is closed wherein the detent projects from the first surface; and wherein the bolt has a second surface for engaging the strike upon closing the door to push the bolt back within the carrier.

15. The emergency door operating apparatus of claims 9, 10, 11, 12, 13 or 14 further including a mounting frame on which the latch and push bar are mounted, said mounting frame having an opening extending therethrough for containing electric lines running from the latch means back to the hinged edge of the door so as to conceal and protect the electric lines.

16. The emergency door operating apparatus of claim 9 wherein the push bar has a channel extending therethrough which channel receives the bell cranks and the tension rod.

17. The emergency door operating apparatus of claim 16 wherein a mounting pedestal extends from the door and has a first slot therethrough for receiving tension rod and a second slot therein for receiving the first arm of the bell crank.

18. A loading mechanism for an emergency exit door latch comprising:

latching means moveable between a latched and an unlatched mode for securing and releasing a door;

means for displacing a fluid;

means for connecting the fluid displacing means to the latching means to displace fluid as the latching means moves from the latched to the unlatched mode;

a normally open valve for normally allowing the fluid to be displaced;

means for closing the normally open valve selectively; and throttle means disposed between the normally open valve and fluid displacing means whereby when the normally open valve is closed the fluid passes through the throttle means rather than through the normally open valve wherein the fluid is throttled which delays displacement of the fluid thereby delaying transition of the latch from the latched to the unlatched mode.

19. The loading mechanism of claim 18 wherein the throttling means comprises:

a body member having a bore therethrough wherein the surface defining the bore has a helical groove therein;

an externally threaded plug having a thread which compliments the helical groove, but which has a diameter less than that of the helical groove, whereby a helical channel is formed for transmitting fluid.

20. The loading mechanism of claim 19, further including:

a support member having a bore therein for receiving the throttle body wherein the bore is circular and the throttle body is polygonal for providing a space between the surface of the bore and the throttle body through which space the fluid normally passes; and means within the bore and on the throttle body for sealing the space when the throttle body is urged there against upon increasing pressure by closing the normally open valve so that the fluid will travel the helical groove through the body member.

21. The loading mechanism of claim 20 wherein the fluid displacing means comprises a cylinder with a piston rod therein which piston rod is driven by the connecting means to move a driving piston which piston displaces the fluid.

22. The loading mechanism of claim 21 wherein the fluid is a liquid and wherein the cylinder cooperates with the throttle means and normally open valve means to form a closed system in which lines connect the cylinder on one side of the piston to the valve and throttle means and connect the valve and throttle means to the cylinder on the other side of the piston.

23. The loading mechanism of claim 22 wherein the normally open valve means and throttle means are connected across the lines in parallel with the throttle means upstream of the normally open valve means.

24. The loading mechanism of claim 23 wherein the cylinder further includes a free piston slideably mounted on the piston rod of the driving piston in spaced relation to the driving piston so as to define a space between the driving and free pistons which space includes a compressible means, whereby when fluid is displaced from one side of the driving piston and accumulated behind the free piston the compressible means is compressed to increase the volume behind the free piston so as to accomodate additional fluid and so as to tend to return the fluid to the first side of the piston when force on the piston rod becomes less than the force holding the compressible means compressed.

25. The loading mechanism of claim 24 wherein the compressible means is a gas.

26. The loading mechanism of claim 25 wherein the support means mounts the cylinder, the normally opened valve means, and the latching means and contains the line between the throttle means and cylinder as well as containing the throttle means.

27. The loading mechanism of claim 26 wherein the latching means includes:

a bolt means;

means mounting the bolt means for movement between a projected position in which the door is latched and a retracted position in which the door is unlatched upon applying pressure to the door;

a toggle link biased normally for dogging the bolt in the projected position and being shiftable to an undogging position for allowing the bolt to retract to move the toggle means toward a collapsed condition, and means to permit the bolt to retract and the door to open;

and wherein, the connecting means includes a cam driven by the toggle link and connected to the piston rod for displacing the piston as the toggle link moves to the collapsed position upon retraction of the bolt.

28. The loading mechanism of claim 27 wherein the means for shifting the toggle link is a push bar which extends across the door and wherein means are positioned between the door and push bar for limiting movement of the push bar to a position sufficient to undog the bolt to thereafter transmit pressure on the pushbar to the door in order to urge the bolt to the retracted position after the bolt is undogged.

29. The loading mechanism of claim 28 further including means for mounting the push bar wherein the mounting means include means for operably connecting opposite ends of the push bar to one another for movement toward the door regardless of the location at which pressure is applied.

30. The loading mechanism of claim 22 wherein the latching means includes:

a bolt means;

means mounting the bolt means for movement between a projected position in which the door is latched and a retracted position in which the door is unlatched upon applying pressure to the door;

a toggle link biased normally for dogging the bolt in the projected position and being shiftable to an undogging position for allowing the bolt to retract to move the toggle means toward a collapsed condition, and means to permit the bolt to retract and the door to open;

and wherein, the connecting means includes a cam driven by the toggle link and connected to the piston rod for displacing the piston as the toggle link moves to the collapsed position upon retraction of the bolt.

31. The loading mechanism of claim 30 wherein the means for shifting the toggle link is a push bar which extends across the door and wherein means are positioned between the door and push bar for limiting movement of the push bar to a position sufficient to undog the bolt to thereafter transmit pressure on the push bar to the door in order to urge the bolt to the retracted position after the bolt is undogged.

32. The loading mechanism of claim 31 further including means for mounting the push bar wherein the mounting means include means for operably connecting opposite ends of the push bar to one another for movement toward the door regardless of the location at which pressure is applied.

* * * * *